US006460389B1

(12) United States Patent
Ammerling et al.

(10) Patent No.: US 6,460,389 B1
(45) Date of Patent: Oct. 8, 2002

(54) METHOD AND APPARATUS FOR ROLLING OF HEATED METALLIC PRODUCTS

(75) Inventors: Willi Juergen Ammerling, Erkrath; Dieter Pfeiffer, Monheim, both of (DE)

(73) Assignee: Kocks Technik GmbH & Co., Hilden (DE)

( * ) Notice: Subject to any disclaimer, the term of this patent is extended or adjusted under 35 U.S.C. 154(b) by 0 days.

(21) Appl. No.: 09/625,715

(22) Filed: Jul. 26, 2000

(30) Foreign Application Priority Data

Jul. 29, 1999 (DE) ..... 199 35 647

(51) Int. Cl.[7] ..... B21B 39/00

(52) U.S. Cl. ..... 72/226; 72/202; 72/228; 72/239; 72/365.2

(58) Field of Search ..... 72/202, 228, 231, 72/233, 227, 226, 239, 365.2

(56) References Cited

U.S. PATENT DOCUMENTS 3,604,238 A * 9/1971 Asari ..... 72/228
5,568,744 A * 10/1996 Grotepass ..... 72/228
5,765,423 A * 6/1998 Cattaneo et al. ..... 72/224
5,857,371 A * 1/1999 Bindernagel et al. ..... 72/224
5,893,288 A * 4/1999 Shore ..... 72/228
6,240,763 B1 * 6/2001 Benedetti ..... 72/239

FOREIGN PATENT DOCUMENTS

DE 1 057 048 5/1959
DE 1 071 025 11/1972
DE 26 57 823 C3 4/1984

* cited by examiner

*Primary Examiner*—Ed Tolan
(74) *Attorney, Agent, or Firm*—Michael J. Striker

(57) ABSTRACT

Rolling of metallic products to be heated to form wires, rods and seamless pipes, includes rolling of wires or rods as well as rolling of seamless pipes on a same rolling apparatus, and using a part of aggregates of the same rolling apparatus both for rolling of wires or rods and for rolling of pipes.

22 Claims, 3 Drawing Sheets

METHOD AND APPARATUS FOR ROLLING OF HEATED METALLIC PRODUCTS

BACKGROUND OF THE INVENTION

The present invention relates to a method of rolling of heated metallic products to form wires, rods or seamless pipes. The products are generally massive billets with a substantially square, rectangular or round cross-sections. These billets are generally produced by rolling or continuous casting. They must be first heated to a rolling temperature at a level is known and depends on the type of the material. Then the here described rolling process is performed for producing of wires, rods or pipes.

In the known rolling process of this type another rolling apparatus is used for producing of wire or rod than for producing of pipes. For example, this is disclosed in German patents 10 57 048, 10 71 025 and 26 57 823. Such roller apparatuses are composed of relatively great number of specially made aggregates. They require separate space in a sufficiently large hall and substantial costs for their installation and operation.

In order to provide an efficient operation of such rolling apparatus which justify their cost, the apparatuses must be designed for a high production per year. In rolling apparatuses for wire, steel or rod steel, the production must be not less than substantially 300,000–500,000 tons per year. For rolling apparatuses for production of seamless steel pipes, the production must not exceed substantially 150,000 tons per year. This high production however frequently corresponds not to the actual demands, in particular when the apparatus operators have only local markets available. Thereby the apparatuses for production 150,000–250,000 of wire or rod steel and 50,000–100,000 tons of stainless steel pipes per year are desired. With the conventional rolling processes on special rolling apparatuses for wires and rods on the one hand, as well as for pipes on the other hand, it is not possible to operate with lower production quantities, such as for example mentioned above, with substantial efficiency. This is true especially when both wires and rods as well as pipes are to be produced and therefore the conventional methods must use two complete rolling apparatuses, whereby the costs are considerably increased.

SUMMARY OF THE INVENTION

Accordingly, it is an object of present invention to provide a method of and an apparatus for rolling which do not have the above mentioned disadvantages, but instead provide for a possibility to produce wires and rods as well as pipes in smaller quantities per year in an efficient manner.

In keeping with these objects and with others which will become apparent herein after, one feature of present invention resides, briefly stated, in that, a rolling of wires and rods on one hand as well as a rolling of seamless pipes on the other hand is performed on the same rolling apparatus, and a part of its aggregates is used both during rolling of wires or rods and also during rolling of pipes.

With this approach the number of the all required aggregates is substantially lower, while some aggregates are utilized both during rolling of wires of rods and during rolling of pipes. This is true especially for the oven, blooming train, some separating devices, the cooling bed and portions of the roller conveyor. The avoidance of a double installation of these aggregates leads to a considerable saving. Also, with such a method a substantially smaller place is needed, so that the halls can be substantially shorter than in the case with conventional rolling in two separate rolling apparatuses. Frequently, an already available hall suffices. Moreover, the same personnel can be used both for the wire/rod production and also for the tube production. Furthermore, offices, infrastructure, shops, energy and media, such as for example current, oil, water, pressure air and the like are needed only for a single rolling apparatus. As a whole, a drastic reduction of cost is obtained, whereby wires, rods and pipes can be produced in an efficient manner even with low production numbers per year.

It is also another object of present invention to provide a rolling apparatus for performing the inventive method. In the rolling apparatus behind an oven and a transverse transporting device, near one another, a rolling line for wires or rods and a rolling line for pipes is arranged, which are united then in a common rolling line with at least one separating device, behind which a cooling bed and/or other finishing devices are arranged. The arrangement of the both rolling lines near one another does not mean that they must extend exactly parallel to one another, while of course it can be advisable in many cases. The rolling lines also must not necessarily form a throughgoing straight line. Billets for wires, rods and pipes can be brought to a rolling temperature in a common oven for both rolling lines, and in any desired row sequence. The transverse transporting device provides the supply of each billet to the rolling line provided for it. Both rolling lines can be operated alternatingly. Therefore, there is a flexiblity with respect to the exchange of programs when within a few minutes the inventive rolling apparatus must be converted from a wire/rod production to a tube production and vice versa.

The corresponding non-used rolling line can be prepared meantime for its next rolling, for example with another cross-section than before. Thereby also maintenance works and repairs can be performed, without disturbing the rolling operation which takes place in the other rolling line and without interrupting the same. Under certain conditions, such as for example when a rolling stand is dispensed with in the region of the common rolling line and a correct determination of the input time point and through going speed, the both separate rolling lines can operate also simultaneously. The above mentioned finishing devices are such aggregates which are used for example for cooling, transportation, testing, collecting, dividing and packing of the finally rolled product.

It is recommended that in the common rolling line the separating devices including a saw and a shears are provided. The saw is better suitable for separating the rolled pipes, while in contrast the wires or rods are better separated with the shears. Both separating devices must be however suitable for separation of continuously running products.

In an apparatus with a cooling bed and other finishing devices, it is in some cases advantageous to provide behind the separating device or devices of the common rolling line but before the cooling bed, a deviation to other finishing devices. All products which can not be supplied directly to the cooling bed since, for example it is wound or looped or further rolled, can be supplied to the corresponding following devices. For this purpose the deviation must be adjusted selectively in one or another direction.

In accordance with a further embodiment of the present invention, behind the separating device of devices of the joint rolling line but before the cooling bed, deviation to rolling block for final rolling of wires can be arranged. This is first of all required during production of wires with a relatively small diameter.

In many apparatuses it is advantageous when in the common rolling line before the separating device or devices, a reducing or sizing rolling block or train is provided. The later differs from the reducing and sizing rolling blocks substantially only by the individually driven rolling stands arranged with a greater distance from one another. With these aggregates both rod-shaped and also tube-shaped products can be finally rolled. Therefore, especially low tolerances and all desired outer dimensions can be provided. Preferably, the rollers are adjustable in a radial direction. Therefore in the event of small changes in the outer diameters no exchange of rollers is needed, but instead only an adjustment of the same. In the event of great changes of the outer diameter, a fast exchange of the rolling stand is performed, and the newly introduced rolling stand can be provided in a stand shop with suitable rollers having a finally adjusted calibrating opening. In this process it does not make any difference whether the changes are performed from a smaller outer diameter to a greater one, or vice versa.

It is especially recommended to arrange a blooming train composed of at least two rolling stands behind the oven and before the transverse transporting device. The blooming train rolls the billets both for the rolling line for wires or rods and also for the rolling line for pipes, and a round cross-section is produced. It is advisable to provide the rolling stands of the blooming train with radially adjustable rollers. Moreover, it is recommended to form the blooming train as a reversible rolling train.

While the blooming train in many cases prepares the product for introduction into the separate rolling lines, also the blooming train can be utilized as a finishing train when rods must be rolled with especially great outer diameters. In such a case it is advisable when behind the blooming train and before the transverse transporting device, a blooming train cooling bed is provided. The finally rolled product from the blooming train can be cooled there, collected and discharged from the rolling apparatus.

It is further recommended to provide a separating device immediately behind the blooming train. With the such an arrangement is possible to subdivide the product rolled in the blooming train to desired lengths. In particular the rolling line for pipes requires shorter preliminary material that normally produced in the blooming train. This separating device serves however also for cutting off of the products exiting the blooming train, so that a substantially flat end surface is obtained to provide an unobjectionable perforation of the products in the rolling line for pipes.

In many cases it is advantageous to arrange a post-heating device behind the transverse transporting device in the rolling line for pipes. With this device the temperature of the products can be brought exactly to such a value which is required for the subsequent perforating and stretching steps.

In the rolling line for pipes a piercing mill, an elongating mill and a stretch reducing mill are arranged one after the other. Basically all known types of these aggregates can be utilized.

It is however advantageous when the stretching rolling stand is provided with a known planetary inclined rolling stand which is located only at a small distance from the stretch reducing mill. With a planetary inclined rolling stand, the rolling product does not rotate during the rolling around its longitudinal axis and therefore can be introduced with its front end portion into the subsequent stretch reducing mill, when a rear end is still rolled in the planetary inclined rolling stand. This makes possible in an advantageous manner a small distance between both rolling aggregates and thereby a short total length of the rolling line for the tube production.

In accordance with the recommended embodiment of the invention, the rolling line for wires or rods and the rolling line for pipes are joined to a common rolling line in the region of their rear longitudinal portions, by means of a transverse pusher. The common rolling line basically can be arranged in alignment with the rolling lines for wires and rods or the rolling line for pipes. A selection of the arrangement depends on the length of the product at this location. The shortest products are transported the best through the transverse pusher, and thereby it can be held as small as possible.

It is advantageous to provide a saw in the rolling line for pipes behind the last rolling stand. The pipes can be cut there to their final length. If thereafter they are supplied via the transverse pusher of the common rolling line, then it can be maintained substantially smaller than known otherwise.

In the rolling line for wires or rods, a number of rolling stands are arranged one behind the other, which at least partially can be assembled to one or several rolling blocks. Moreover, between the rolling stands or rolling blocks, shears are provided. They serve for cutting off of disturbing ends, and during interferences also for comminuting the rolling product.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
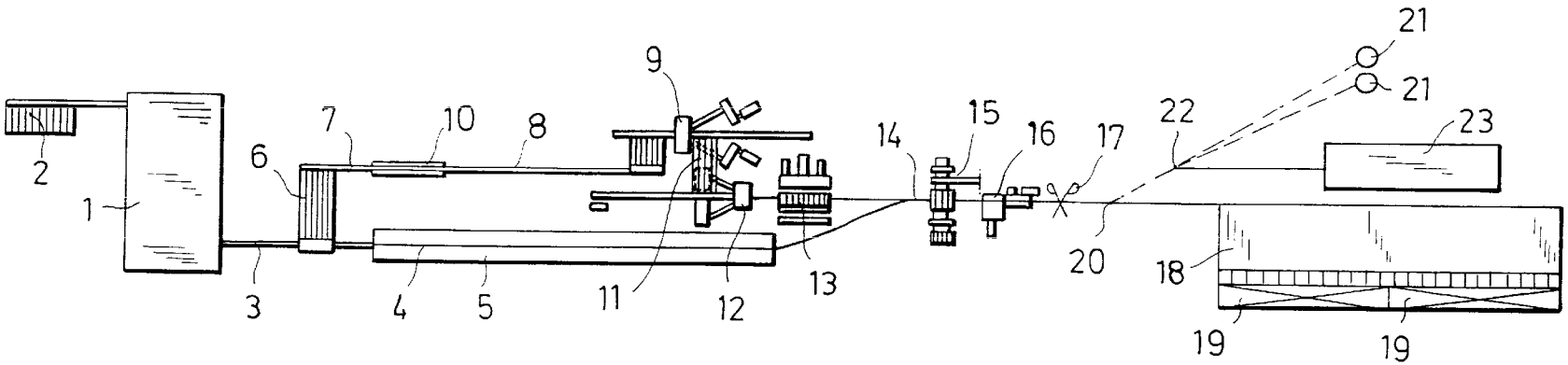
FIG. 1 is a schematically shown plan view of a rolling apparatus in accordance with the present invention.

A rolling apparatus in accordance with the present invention has an oven 1 provided with a loading device 2 for a metallic product having a round cross-section as shown in FIG. 1. The product is heated in the oven 1 to a rolling temperature. Through a rolling conveyor 3 it is supplied to a rolling line 4 for rolling of wires or rods. In this rolling line 4 a great number of rolling stands are arranged one behind the other. They also can form one or several rolling blocks. Moreover, shears and other devices can be arranged between the rolling stands or rolling blocks. Since such rolling trains for rolling of wires or rolling rods are known in various modifications and widely utilized, a box 5 identifies such a rolling train to simplify the drawings.

A transverse transporting device 6 is arranged in the region of the rolling conveyor 3. The product coming from the oven 1 can be supplied by the transverse transporting device selectively to a second rolling line 7. This second rolling line 7 serves for rolling of seamless pipes. A rolling conveyor 8 brings the products to a piercing mill 9. In order to efficiently guarantee that the product during entering the piercing mill 9 has a required temperature, a preferably electrical inductive post-warming device 10 is provided in the region of the roller conveyor 8.

From the outlet side of the perforating rolling stand 9, the product is supplied as a whole block via a transverse conveyor 11 to an inlet side of an elongating mill 12, where it is stretched to a pipe loop. The elongating mill 12 is formed as a planetary inclined rolling stand so that a stretch reducing mill 13 can follow it at a short distance.

The both rolling lines 4 and 7 are united to form a common rolling line 14, behind the stretch reducing mill 13 of the rolling line 7 and behind the last rolling stand of the rolling line 4. The rod-like product coming from the rolling line 4 or the tubular product coming from the rolling line 7 is supplied in the common rolling line 14 to a multi-stand sizing rolling train 15. There the product obtains the final outer diameter with narrow tolerances. If the desired dimensions and tolerances are obtained already in the preceding rolling lines 4 or 7, then the sizing rolling train 15 can be dispensed with.

In the common rolling line 14 shown in FIG. 1 both a saw 16 and also a shears 17 are incorporated. While the rolling line 4 utilizes in operation the shear 17, the saw 16 is used when pipes are produced from the rolling line 7. These separating devices 16 and 17 cut the product to the desired final lengths. After the cutting, the product is supplied for example to a cooling bed 18 where it is cooled and collected in troughs 19. A deviating element 20 is provided behind the last separating device 16 or 17 but before the cooling bed 18, and it leads to winders 21. There as an alternative the product can be wound to bundles, when with relatively small outer dimensions it can be sufficiently bendable. A further alternative is that, before the cooling bed 18 and before the winders 21, another deviating member 22 is arranged. It supplies the suitable product, namely such from the rolling line 4, to a wire rolling block 23 where the wire can be produced with a particularly small diameter.

Figure 2:
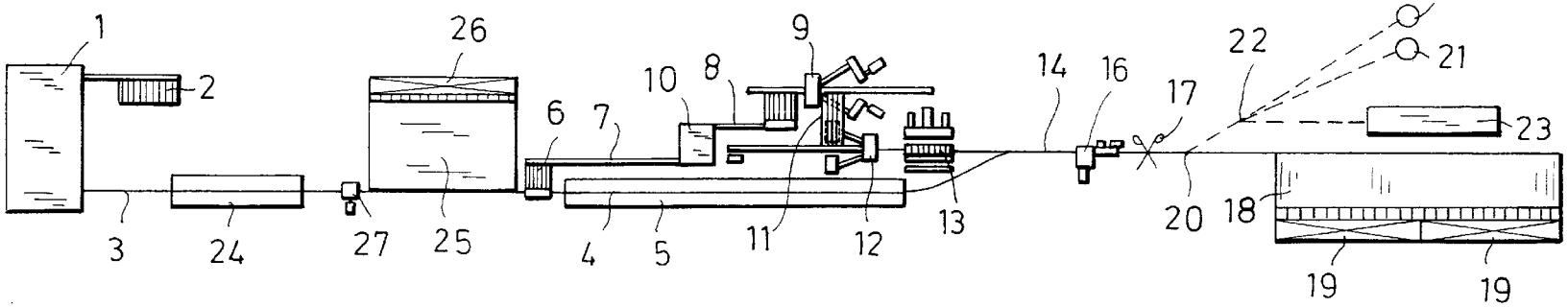
FIG. 2 is a view showing a rolling apparatus similar to the rolling apparatus of FIG. 1, but provided with a blooming train.

The embodiment of FIG. 2 substantially corresponds to the embodiment of FIG. 1 and therefore the same elements are identified with the same reference numerals. In contrast to FIG. 1, the roller conveyor 3 leads from the oven 1 first to blooming train 24. Here the product is pre-rolled for the corresponding rolling process in the rolling lines 4 or 7. The rolling lines 4 or 7 require in all cases the products with a round cross-section. If however the product with a polygonal cross-section is available, it can be deformed in the blooming train 24 to a round cross-section. With the rolling apparatus shown in FIG. 2, also the product with other cross-sections which are different from a round cross-section can be processed. Moreover in the blooming train 24 the products with greater outer dimensions can be reduced to initial dimensions which are suitable for the rolling lines 4 and 7. It is further possible to use the blooming train 24 for final rolling, when the product with correspondingly great cross-sections is desired. For this purpose before the transverse transporting device 6, a blooming train cooling bed 25 with a collecting trough 26 is arranged behind the blooming train 24. A separating device 27 for cutting the products for the rolling lines 4 and 7 or for separating the products for the blooming train cooling bed 25 is provided between the blooming train 24 and the blooming train cooling bed 25.

The common rolling line 14 in FIG. 2 does not have the size rolling train 15. However, it can be also provided in this embodiment, as in the embodiment of FIG. 1.

Figure 3:
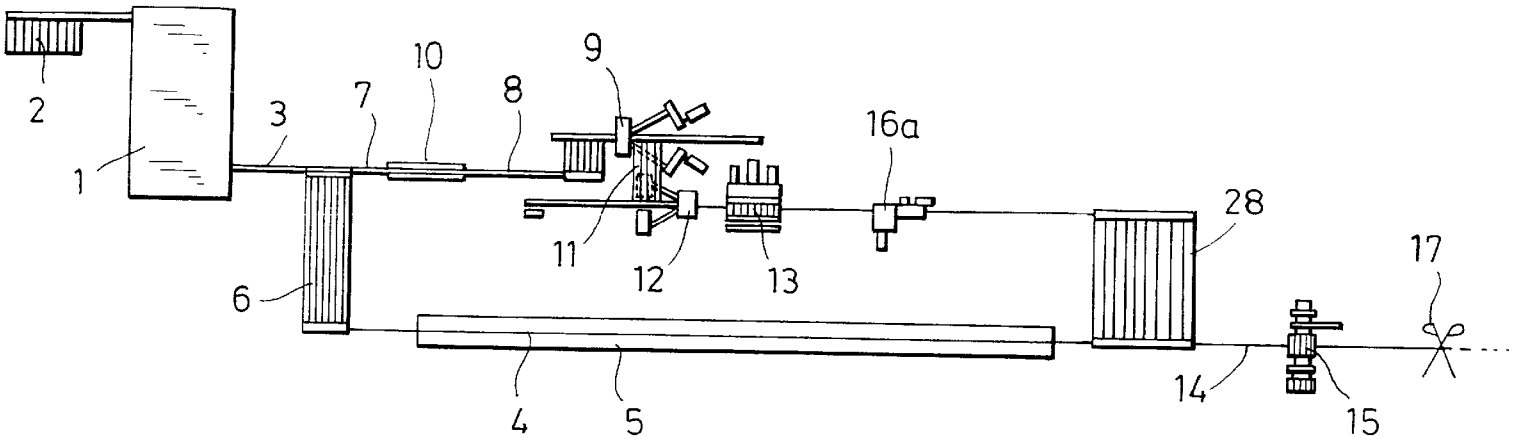
FIG. 3 is a view showing a rolling apparatus similar to the rolling apparatus of FIG. 1, but provided with a transverse pusher.

The apparatus in accordance with the embodiment shown in FIG. 3 corresponds in its front and central part to the apparatus of the embodiment of FIG. 1, while the front part also can be provided with a blooming train 24. A blooming train cooling bed 25 can be also used or can be dispensed with, as is the case in FIG. 2. The apparatus in accordance with this embodiment is different in that, the rolling lines 4 and 7 are united with one another to the common rolling line 14 by means of a transverse pusher 28. For the case when as in FIG. 2 a sizing roller train 15 can be dispensed with, the transverse pusher 28 is used as a cooling bed for the pipes from the rolling line 7. In order to make this possible, the saw 16 in FIG. 3 is no longer arranged in the common rolling line 14, but instead it is arranged in the rolling line 7 behind the stretching reducing rolling train 13, where it is identified with 16*a*. The shears 17 can be formed in correspondence with FIGS. 1 and 2 in the apparatus end portion which is not shown in FIG. 3. Also, individual devices can be dispensed with.

It will be understood that each of the elements described above, or two or more together, may also find a useful application in other types of constructions differing from the types described above.

While the invention has been illustrated and described as embodied in a method of and apparatus for rolling of heated metallic products, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

What is claimed is:

1. A method of rolling metallic products to be heated to form wires, rods and seamless pipes, comprising the steps of rolling of wires or rods as well as rolling of seamless pipes on a same rolling installation which includes a plurality of individual aggregates; and using a part of the aggregates of the same rolling installation both for rolling of wires or rods and for rolling of pipes.

2. A rolling installation for rolling metallic products to be heated to form wires, rods, or pipes, the rolling installation comprising a rolling line for rolling wires or rods and including a plurality of individual aggregates; a rolling line for rolling of pipes and including a plurality of individual aggregates, said rolling lines being arranged near one another and thereafter united to form a common rolling line, so that a part of the aggregates of the rolling installation are used both for rolling of wires or rods and for rolling of pipes.

3. A rolling installation as defined in claim 2, wherein said aggregates include an oven and a transverse transporting device behind which said rolling lines are located, and at least one separating device provided in said common rolling line, with at least one additional device following said separating device.

4. A rolling installation as defined in claim 3, wherein said additional device is a cooling bed.

5. A rolling installation as defined in claim 3, wherein said additional device is a finishing device.

6. A rolling installation as defined in claim 2, wherein said common rolling line is provided with separating devices including a saw and a shears.

7. A rolling installation as defined in claim 2, wherein said aggregates include a separating device provided in said common rolling line, a cooling bed and a finishing device provided behind said separating device, and a deviating device provided before said cooling bed and leading to said finishing device.

8. A rolling installation as defined in claim 2, wherein said aggregates include a separating device provided in said common rolling line, a cooling bed, and a deviating device provided before said cooling bed for deviating to a rolling block for final rolling of wire.

9. A rolling installation as defined in claim 2, wherein said common rolling line has a separating device, and wherein said aggregates include a reducing and sizing rolling block arranged before said separating device.

10. A rolling installation as defined in claim 2, wherein said common rolling line has a separating device, and wherein said aggregates include a reducing and sizing rolling train arranged before said separating device.

11. A rolling installation as defined in claim 3, wherein said aggregates include a blooming train composed of at least two rolling stands and located behind said oven and before said transverse transporting device.

12. A rolling installation as defined in claim 11, wherein said rolling stands of said blooming train have radially adjustable rollers.

13. A rolling installation as defined in claim 11, wherein said blooming train is formed as a reversing rolling train.

14. A rolling installation as defined in claim 11, wherein said aggregate include a blooming train cooling bed provided behind said blooming train and before said transverse transporting device.

15. A rolling installation as defined in claim 11, wherein said aggregates include a separating device provided behind said blooming train.

16. A rolling installation as defined in claim 3, wherein said aggregates include a post-heating device arranged behind said transverse transporting device in said rolling line for pipes.

17. A rolling installation as defined in claim 2, wherein said aggregates include a piercing mill, an elongating mill, and a stretch reducing mill arranged one after the other in said rolling line for pipes.

18. A rolling installation as defined in claim 17, wherein said elongating mill is forming as a planetary inclined rolling stand located at a short distance before said stretch reducing mill.

19. A rolling apparatus as defined in claim 2, and further comprising a transverse pusher which connects said rolling line for rolling wires or rods and said rolling line for rolling of pipes in their rear longitudinal portion to form said common rolling line.

20. A rolling apparatus as defined in claim 2, and further comprising a saw provided in said rolling line for pipes behind a last rolling stand.

21. A rolling apparatus as defined in claim 2, wherein said rolling line for rolling wires or rods is provided with a plurality of rolling stands located one behind the other and assembled at least partially to one or more rolling blocks.

22. A rolling apparatus as defined in claim 21, wherein said rolling line for rolling wires or rods is provided with shears between said rolling stands or said rolling blocks.

* * * * *